United States Patent [19]

Carella

[11] Patent Number: 4,909,232

[45] Date of Patent: Mar. 20, 1990

[54] SHOOTING AND TRAINING DEVICE FOR ARCHERY

[76] Inventor: Richard F. Carella, 35572 Strathcona Dr., Mount Clemens, Mich. 48043

[21] Appl. No.: 58,395

[22] Filed: Jun. 5, 1987

Related U.S. Application Data

[63] Continuation-in-part of Ser. No. 934,674, Nov. 25, 1986, which is a continuation-in-part of Ser. No. 891,863, Jul. 30, 1986, abandoned, which is a continuation-in-part of Ser. No. 848,983, Apr. 7, 1986, abandoned.

[51] Int. Cl.[4] ..... F41B 5/00; A63B 21/02

[52] U.S. Cl. ..... 124/35 A; 124/86; 272/137; 272/143

[58] Field of Search ..... 124/23 R, 86, 35 R, 124/35 A, 20 R, 88, 90, 80; 434/247, 258; 272/135, 142, 143, 67, 68, 137, 141

[56] References Cited

U.S. PATENT DOCUMENTS

| | | | |
|---|---|---|---|
| 3,462,142 | 8/1969 | Sterndale | 272/133 |
| 4,041,926 | 8/1977 | Troncoso, Jr. et al. | 124/35 A |
| 4,079,933 | 3/1978 | Everroad | 272/121 |
| 4,160,437 | 7/1979 | Fletcher | 124/35 A |
| 4,245,840 | 1/1981 | Van Housen | 272/137 |
| 4,403,594 | 9/1983 | Todd | 124/35 A |
| 4,489,705 | 12/1984 | Larson | 124/35 A |
| 4,539,968 | 9/1985 | Garvison | 124/35 A |
| 4,609,191 | 9/1986 | Remme | 272/143 X |

FOREIGN PATENT DOCUMENTS

| | | | |
|---|---|---|---|
| 562787 | 10/1932 | Fed. Rep. of Germany | 272/142 |

*Primary Examiner*—Randolph A. Reese
*Assistant Examiner*—Peter M. Cuomo
*Attorney, Agent, or Firm*—Brooks & Kushman

[57] ABSTRACT

An archery shooting and training device (20) is disclosed for teaching an archer proper muscular control and body positioning. The shooting and training device (20) includes a string arm connector (70) that is securable without shifting to the upper arm and forearm of the archer's string arm. A draw force carrying member (72) extends from the string arm connector (70) to a release mechanism (130) having an anchor point (54) to position the archer's body on a plane of release that prevents movement which would adversely affect accuracy upon string release during actual shooting. The device (20) can be used with an actual bow, and is also usable with a front portion (110) and a bow handle (62) to provide a simulated bow force by isometrics. Also, another embodiment of the device (20) has a tether (117) including a loop (119) which connects the front portion (110) to the bow arm, so that when the release mechanism (130) is activated, the front portion (110) is retained by the bow arm, thus facilitating reassembly of the device (20) after release. The device (20) is also used to study and teach body reaction movements upon release.

25 Claims, 3 Drawing Sheets

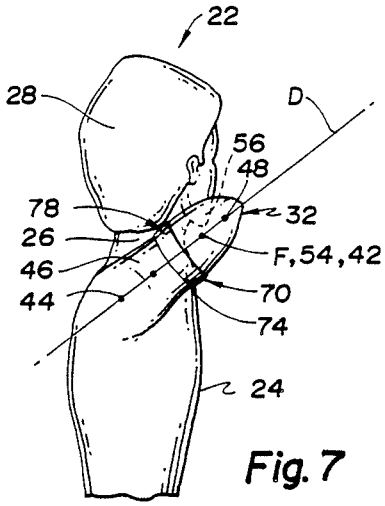
Fig. 7
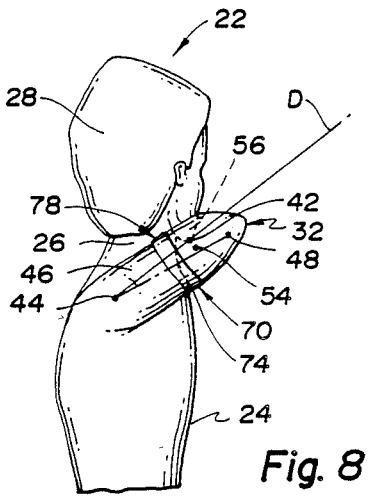
Fig. 8
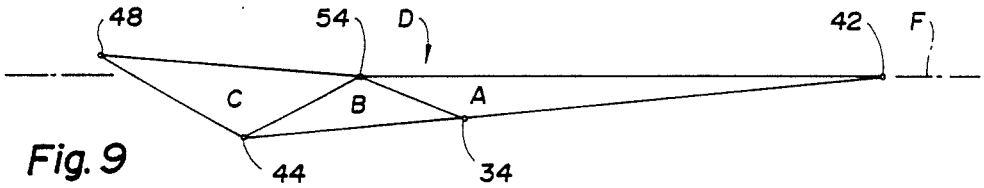
Fig. 9
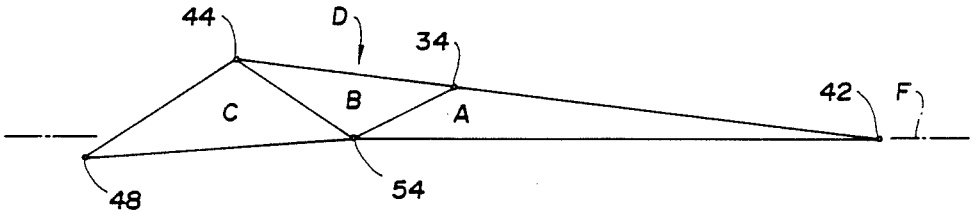
Fig. 10
Fig. 11
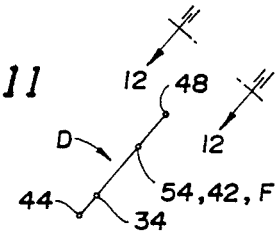
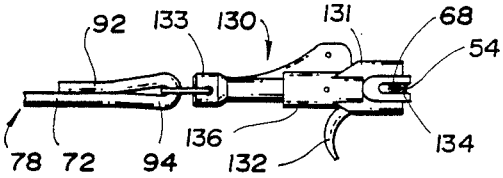
Fig. 13
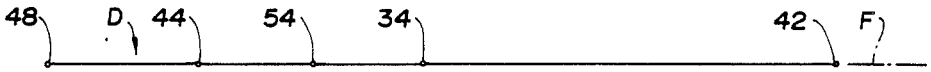
Fig. 12

SHOOTING AND TRAINING DEVICE FOR ARCHERY

CROSS REFERENCE TO RELATED APPLICATION

This application is a continuation-in-part of prior copending parent application Ser. No. 934,674 which was filed on Nov. 25, 1986 as a continuation-in-part of prior copending grandparent application Ser. No. 891,863 filed on July 30, 1986, now abandoned, which in turn is a continuation-in-part of prior copending great grandparent application Ser. No. 848,983 which was filed on Apr. 7, 1986, now abandoned.

TECHNICAL FIELD

This invention relates to an archery shooting and training device for assisting an archer, and teaching the archer proper muscular control and body positioning in the drawn stance upon string release.

BACKGROUND ART

Archers have previously recognized an imaginary draw force line along which the bow force is carried between the bow hand and string hand through an anchor point at which the arrow is knocked. However, the full significance of the archer's stance in holding the bow force has not heretofore been fully understood. Rather, the archer's stance in the drawn position has previously been analyzed by what "looks" or "feels" right without appreciating the effect the bow force has on the body upon shooting. Thus, the sport of archery has not previously recognized the static and dynamic force considerations involved with shooting, nor has there been any recognition of body movements that can cause shooting inaccuracies if the archer is not properly positioned upon string release.

One presently available archery practice device includes a bow handle from which a pair of rubber-like strands extend for attachment to a simulated bow string. This practice device is designed to develop upper body strength and does not teach proper upper body positioning with correct muscle use nor does the device serve as an aid during the act of shooting an arrow.

DISCLOSURE OF INVENTION

After over thirty years of being involved in the sport of archery and twelve years of study of muscle anatomy in relationship thereto, I have discovered a concept that serves as an aid during shooting and facilitates an understanding of the forces involved to permit improvement of shooting accuracy. These forces include the static forces necessary to hold the bow force as well as the dynamic forces necessary to pull the string back to the fully drawn position.

If one observes an archer shooting a bow and arrow, one can occasionally observe a flinching or collapsing of the archer's frame, just as he or she is about to release the bow string. What has caused this flinching and collapsing of the archer's frame is that the archer relaxed his or her muscles too soon before releasing the bow string. The reason for this phenomenon is that all archers relax their muscles a fraction of a second before releasing the bow string. This phenomenon of relaxing the muscles is sometimes termed "the timing of the shot". For good timing of the shot, the muscles should relax about one tenth of a second or less before releasing the bow string.

It must be appreciated that even a very slight movement of the bow hand or an anchor point from the intended trajectory can produce significant error in shooting accuracy. For example, competition archery shot at a ninety meter length uses a bull's-eye of approximately 9.6 inches in diameter and, assuming that the bow hand remains stationary, requires that the anchor point where the arrow is knocked be located within a circle whose diameter is only approximately 73 thousandths of an inch. Thus, movement of the anchor point or the bow hand even a very small amount upon arrow release has a substantial effect in shooting accuracy.

The concept which I have developed is termed the "plane of release". An archer properly positioned on the plane of release can statically and dynamically counteract the bow force with his or her muscles such that, upon string release, the anchor point does not move up, down, or off the plane of release so that the bow hand reacts forwardly in a manner that does not adversely affect shooting accuracy. An understanding of the forces involved with plane of release shooting has also made it possible to develop an archery shooting and training device according to the present invention for teaching an archer proper muscular control and body positioning.

The concept I have developed involves positioning three triangles of the archer's stance along a plane of release that insures accurate shooting by limiting the bow hand and string hand reactions upon string release to forward and rearward movements, respectively, along the intended trajectory. This plane of release includes a bow arm triangle, a body triangle, and a string arm triangle that must all be coplanar with each other to define the plane of release, along which accurate shooting can be executed. All three of these triangles have a common vertex at the anchor point where the arrow is knocked with the bow string. The bow arm triangle is defined by the bow hand, the bow shoulder and the anchor point, while the body triangle is defined by the bow and string arm shoulders and the anchor point, and the string arm triangle is defined by the string arm shoulder, the string arm elbow and the anchor point. These triangles are rotatably positioned with respect to each other about imaginary hinge lines between the anchor point and the shoulders. Positioning of all three triangles about their associated hinge lines so as to be coplanar with each other on the plane of release in the drawn stance provides shooting accuracy that is not otherwise attainable.

Accordingly, one object of the present invention is to provide an archery shooting and training device for teaching an archer proper muscular control and body positioning for accurate shooting. Another object of the invention is to provide the archery shooting and training device that teaches an archer to move the entire upper body when changing aiming trajectories for different ranges. A further object of the invention is to provide the shooting and training device that permits bow handle angular adjustment to suit each archer using the device.

In carrying out the above objects, the invention includes a string arm connector that is securable without shifting to the archer's string arm adjacent his or her elbow. A draw force carrying member of the device extends forwardly from the string arm connector toward the anchor point. Connected to the draw force carrying member adjacent the anchor point is a release mechanism. Thus, the shooting and training device serves to position the archer's bow hand, string arm, shoulders, and the anchor point along a plane of release where the muscles properly hold the bow force with positioning that maintains the bow hand and the anchor point against movement that would adversely affect accuracy upon string release during actual shooting.

Different embodiments of the device are disclosed as being usable with the release mechanism at the anchor point to permit the device to be used during actual shooting of an arrow by a bow or to teach the archer correct timing of the release, or to teach the archer correct bow hand reaction upon release, or a bow handle of either a contoured or strap construction for providing the draw force by isometrics.

To use each embodiment of the shooting and training device, the archer pushes against the form of bow handle selected with the bow arm and pulls the string arm connector with the string arm until the anchor point is properly located while the archer's body is loaded with the actual bow draw force, isometric forces, or a spring force that simulates the bow draw force. In the proper position, the bow arm triangle defined by the anchor point and the bow arm shoulder and hand, the body triangle defined by the anchor point and the bow arm and string arm shoulders, and the string arm triangle defined by the anchor point and the string arm shoulder and hand are all located on the plane of release. Loading of the body on the plane of release through "muscle memory" trains the archer to duplicate the proper positioning when shooting. Also, the muscles that provide dynamic movement as the arrow is drawn cannot move the body from the correct position on the plane of release without causing movement of the anchor point in a manner that is readily observed by the archer. This also teaches the archer to move the entire body when changing aiming trajectories for different shooting ranges.

As disclosed, the archery shooting and training aid includes the release mechanism. Thus, the shooting and training aid with the release mechanism enables the archer to train his muscles to relax for just a fraction of a second before releasing the bow string, or relaxation timing. Because the bow force is transmitted to the archer's string elbow, any premature relaxation of the archer's back muscles or other muscles related to the archer's frame, amplifies the shooting error. In order to shoot correctly, the archer must have his frame on the plane of release and must coordinate the timing of his muscle relaxation precisely with his release of the bow string.

As disclosed, the shooting and training aid teaches the archer how to achieve consistent, correct reaction of the bow hand upon string release. The correct reaction is apparent when, after release, no flinching or collapsing of the archer's frame is apparent.

In the preferred construction of the shooting and training device, the string arm connector includes a pair of loops that are respectively securable to the upper arm and the forearm of the string arm adjacent the elbow. A strap of the shooting and training device preferably defines the pair of loops and distributes between the upper arm and forearm the force applied to the string arm during use. This strap is constructed to define a slip loop through which the strap itself passes in order to define the pair of loops, such that the application of force snugly tightens the pair of loops.

In the preferred construction, the draw force carrying member has an adjuster for changing the length of the draw force carrying member, by adjusting the distance between the anchor point and the elbow of the string arm. The draw force carrying member preferably has a cord-like construction, and the adjuster connects the cord-like draw force carrying member to the strap that defines the pair of loops which are securable to the string arm. As disclosed, the adjuster comprises a U clamp that is tightened to secure the draw force carrying member with the properly adjusted length between the anchor point and the string arm elbow. Adjacent the anchor point, the draw force carrying member includes the release mechanism that is disclosed as having a trigger in each of the embodiments.

The release mechanism has a forward end at which the anchor point is located, a rear end which is connected to the draw force carrying member, and an intermediate portion that supports the trigger.

One of the disclosed embodiments of the archery shooting and training device is used with an archery bow, with the release mechanism secured to the bow string. The actual bow force in this embodiment thus provides the loading, with the string arm connector locating the anchor point in the proper position when the archer's body is on the plane of release, as previously described.

Another embodiment of the shooting and training device provides loading of the archer's body by isometrics. This embodiment has the draw force carrying member provided with a front portion which extends forwardly from the release mechanism and has the simulated bow handle held by the bow hand of the archer. The front portion of the draw force carrying member preferably has a cord-like construction and includes a ring fixedly connected to the front portion. The ring is detachably secured to the release mechanism which, upon activation, releases the ring. An adjuster adjusts the length between the release mechanism and the bow handle. One of the isometric embodiments has the handle provided with a contoured construction for either a left-hand or right-hand archer, while the other of these embodiments has the handle provided by a strap. Both of the isometric embodiments have the adjuster of the front portion of the draw force carrying member providing the connection thereof to the associated bow handle so as to provide the adjustment of length between the release mechanism and the bow handle.

As still another embodiment of the invention, the strap, which is connected to the front portion of the draw force carrying member, comprises an elastic-like material which extends under tension, and upon release, returns to its relaxed dimensions.

As disclosed, the front portion of the draw force carrying member includes a tether which connects the front portion to the bow arm so that when the release mechanism is activated, the front portion of the draw force carrying member is retained by the bow arm, thus facilitating reassembly of the device after release.

The objects, features, and advantages of the present invention are readily apparent from the following detailed description of the best modes for carrying out the invention when taken in connection with the accompanying drawings.

BRIEF DESCRIPTION OF DRAWINGS

FIG. 7 is a rear view taken along the direction of line 7—7 in FIG. 5 to still further illustrate the use of the shooting and training device;

FIG. 8 is a rear view taken in the same direction as FIG. 7 to illustrate improper positioning where the string arm is dropped in a manner that is corrected by use of the shooting and training device;

FIG. 9 is a schematic side view corresponding to FIGS. 4 and 5 and illustrates bow arm, body, and string arm triangles that are all aligned on a plane of release to give proper shooting as taught by use of the device;

FIG. 10 is a schematic side view corresponding to FIG. 6 and further illustrates the bow arm, body, and string arm triangles of the plane of release;

FIG. 11 is a inclined rear edge view corresponding to FIG. 7 and further illustrates the plane of release;

FIG. 12 is a top view taken along the direction of line 12—12 in FIG. 11 to still further illustrate the plane of release; and FIG. 13 is a view of the string release mechanism that is used at an anchor point with each embodiment of the invention to permit training and actual shooting of an arrow by a bow.

BEST MODES FOR CARRYING OUT THE INVENTION

Figure 1:
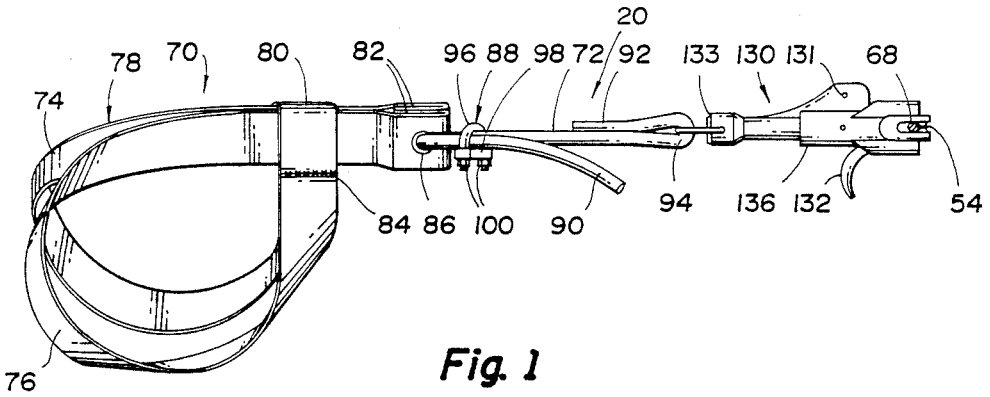
FIG. 1 is a top view of an archery shooting and training device that is used with a release mechanism and an archery bow or a front portion, and constructed in accordance with the present invention.
Figure 2:
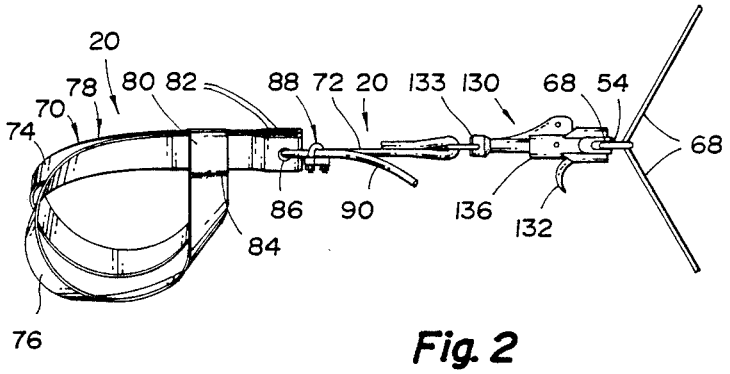
FIG. 2 is a top view of an embodiment of the archery shooting and training device constructed in accordance with the present invention, including an archery bow and a string arm connector for loading a draw force carrying member by isometrics.
Figure 3:
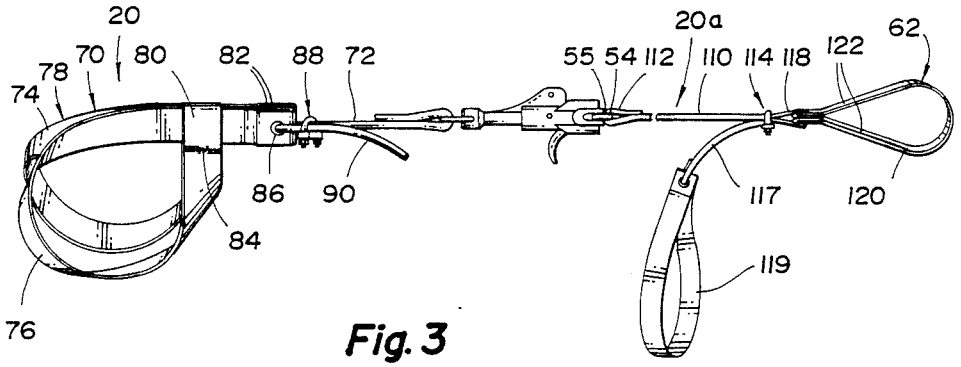
FIG. 3 is a side view of another embodiment of the archery shooting and training device constructed in accordance with the present invention in which a strap simulates a bow handle, and the string arm connector is linked to the release mechanism for loading the draw force carrying member by isometrics.
Figure 4:
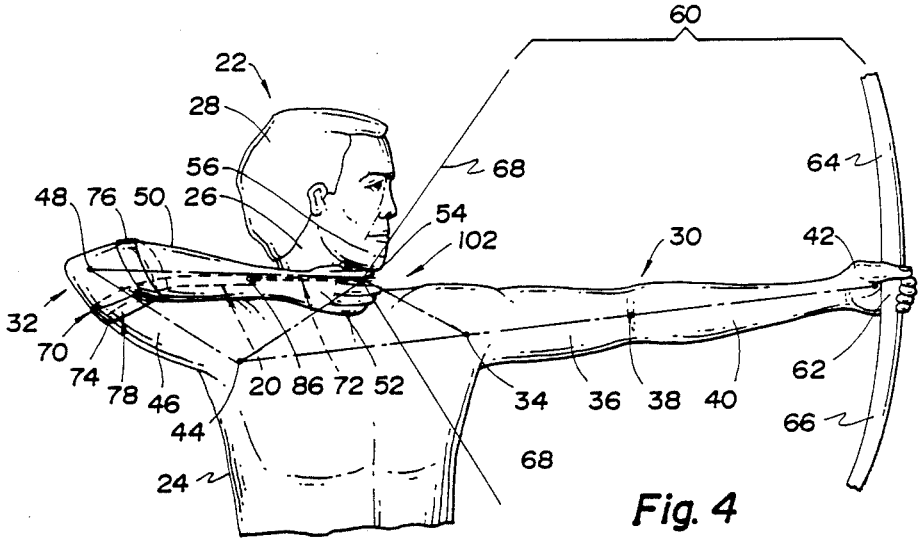
FIG. 4 is a side view of a right-hand archer using the FIG. 1 or FIG. 2 embodiment of the shooting and training device.

One embodiment of an archery shooting and training device constructed in accordance with the present invention is identified generally by reference numeral 20 in FIG. 1 and is further illustrated in FIGS. 2 and 4. Another embodiment 20*a* of the archery shooting and training device is illustrated in FIG. 3 and is further illustrated in FIGS. 5 and 6. Also, FIG. 13 illustrates a string release mechanism that is used with an embodiment of the device like the one in FIG. 1 to provide an aid in actual shooting of arrows by a bow or to study and teach the body reactions of the archer upon release. Each embodiment of the training device teaches an archer proper positioning to prevent inaccuracies in shooting such as will result with the string arm positioned too low as shown in FIG. 8. An understanding of the concept that resulted in development of the shooting and training device is facilitated by the schematic views of FIGS. 9 through 12 which illustrate a plane of release positioning that provides for consistent and accurate shooting.

Before describing the construction of each embodiment of the archery shooting and training device, it is necessary to understand the plane of release concept, the development of which is the genesis of this invention. For an understanding of this plane of release concept, it is necessary to first make reference to the archer's body parts as illustrated in FIGS. 4 through 8 so that the elements of the plane of release can be defined. The archer 22 illustrated in FIGS. 4 and 5 has a torso or body 24 on which the neck 26 supports his head 28 between the forwardly projecting bow arm 30 and bent string arm 32. The bow arm 30 extends from the bow shoulder 34 and includes an upper arm 36, an elbow 38, a forearm 40, and a bow hand 42 for holding the bow during shooting. The string arm 32 extends from the string shoulder 44 and has an upper arm 46, an elbow 48, a forearm 50 that is bent forwardly at the elbow, and a string hand 52 located at a simulated knocking or an anchor point 54 where the arrow is knocked with the bow string adjacent the neck 26 and chin 56.

The plane of release concept I have developed can best be understood by combined reference to FIGS. 4 through 8 showing the archer 22 and to the schematic views of FIGS. 9 through 12. The bow shoulder 34, bow hand 42, and the anchor point 54 in archery define an archer's bow arm triangle identified as A in FIGS. 9 and 10. Bow shoulder 34, string shoulder 44, and the anchor point 54 define the archer's body triangle which is identified as B in the schematic views of FIGS. 9 and 10. Furthermore, string shoulder 44, the string arm elbow 48, and the anchor point 54 at which the string hand 52 is located define a string arm triangle that is identified as C in the schematic views of FIGS. 9 and 10. Bow arm triangle A, body triangle B, and string arm triangle C when properly positioned define a single plane of release D best illustrated in FIGS. 7, and 12. Also, in this plane of release, the shoulders 34 and 44 form a straight line with the bow hand 42 when the draw length is correct.

With the archer positioned so that the bow arm triangle A, body triangle B, and string arm triangle C are along the plane of release D, the bow force is held by the archer's body between the bow hand 42, and the string hand 52 at the anchor point 54 along a bow and body force line F which lies on the plane of release D as shown in FIGS. 8 and 10 through 12. With this positioning, the bow force does not tend to move the bow hand 42 or string hand 52 at the anchor point 54 from alignment with the intended trajectory of the arrow. Upon string release with the archer using proper muscle control in the plane of release positioning, the bow force is instantaneously removed from the archer's body and the body reaction is forward and rearward movements of the bow and string hands 42 and 52 along the intended trajectory line F which then constitutes a reaction line.

Without the positioning on the plane of release, the bow hand 42 and/or string hand 52 tend to move vertically or horizontally from the intended trajectory upon shooting and thereby adversely affect shooting accuracy. This results when the bow arm triangle A is rotated with respect to the body triangle B about the hinge line between the anchor point 54 and bow arm shoulder 34 so as to be off the plane of release, and when the string arm triangle C is rotated with respect to the body triangle B about the hinge line between the anchor point 54 and string arm shoulder 44 so as to be off the plane of release.

If the string arm is positioned below the plane of release as shown in FIG. 8, the resultant force tends to move the anchor point away from the neck and chin upon string release. Furthermore, if the string arm is positioned above the plane of release, the resultant force tends to move the anchor point toward the neck and chin upon string release. Likewise, if the body is rotated counterclockwise from the position of FIGS. 6 and 10, the bow shoulder 34 is positioned off the plane of release D, such that the bow arm triangle A is not coplanar with the body triangle B, while the string arm triangle C may or may not be coplanar with the body triangle B. Upon string release from this position, the body pivots clockwise as viewed in FIGS. 6 and 10 and a bow handle 42 moves toward the left from the intended trajectory of the arrow. As previously mentioned, even a very small amount of movement caused by the resultant force due to positioning off the plane of release will introduce shooting inaccuracy.

With reference to FIGS. 1 and 4 of the drawings, the embodiment 20 of the archery shooting and training device shown in FIG. 1 is utilized with a bow 60 as shown in FIG. 4. Specifically, the bow handle 62 is held by the bow hand 42 with the upper and lower bow limbs 64 and 66 projecting vertically from the handle to attach the upper and lower ends of the bow string 68 which is secured by the shooting and training device 20 at the anchor point 54. Shooting and training device 20 includes a string arm connector 70 that is securable without shifting to the upper arm 46 and forearm 50 of the string arm 32. A draw force carrying member 72 extends from the string arm connector 70 toward the anchor point 54 to carry the bow force between the string arm elbow 48 and the bow hand 42 as shown in FIGS. 2 and 3. Any movement of the archer's body 24 from the plane of release in the drawn position of FIG. 4 will tend to move the anchor point 54 from its proper location which is observable by the archer who can then correct the error. Thus, the archer's muscles properly hold the bow force with positioning that maintains the bow hand 42 and the anchor point 54 against movement that would adversely affect accuracy upon string release during actual shooting.

In the preferred construction of the shooting and training device 20 as shown in FIG. 1, the string arm connector 70 includes a pair of loops 74 and 76 that are respectively securable to the upper arm 46 and forearm 50 of the string arm 32 adjacent the elbow 48. The string arm connector 70 preferably includes a strap 78 that defines the pair of string arm loops 74 and 76 in order to distribute the bow draw force on the string arm during use. This strap 78 is most preferably woven from synthetic resin fibers so as to be durable without soiling. A slip loop 80 provided by strap 78 has double ends 82 of the strap passing there through in order to define the pair of string arm loops 74 and 76. This slip loop 80 is provided by securing strap portions to each other at 84, preferably by heat welding the strap portions which are made of thermoplastic fibers that permit such heat securement. Adjacent the attachment of the string arm connector 70 to the draw force carrying member 72, the strap ends 82 are folded back inwardly adjacent each other to provide four strap layers through which a hole 86 is provided in order to reinforce the attachment to the draw force carrying member.

As illustrated by continuing reference to FIG. 1, the draw force carrying member 72 has an adjuster 88 that adjusts its length in order to locate the release mechanism 130 and the anchor point 54 at a suitable distance from the string arm elbow of the archer using the device. The draw force carrying member 72 preferably has a flexible cord-like construction having one end 90 that is passed through the strap end hole 86 of the string arm connector 70 to permit adjustable securement at that location by the adjuster 88. Another end 92 of the cord-like draw force carrying member 72 is secured to itself to provide the anchor point connector loop 94, with this securement preferably being provided by heating of thermoplastic synthetic resin fibers from which the draw force carrying member is made.

In FIG. 1, the adjuster 88 is embodied by a U clamp having a U-shaped clamp member 96 and a bar clamp member 98 that extends between the legs of the U-shaped clamp member to capture the two strands of the draw force carrying member 72 adjacent its end 90 which passes through the string arm connector strap hole 86. A pair of nuts 100 secure the bar clamp 98 to threaded ends on the legs of the U-shaped clamp member 96 to tightly grip the two strands of the cord-like end 90 of the draw force carrying member 72 after appropriate adjustment to provide the correct distance between the anchor point 54 and the string arm elbow.

It should be appreciated that other constructions of the adjuster 88 are possible. For example, it is possible to utilize a number of half hitch knots of the cord-like draw force carrying member 72 so as to eliminate the need for a separate component. Likewise, it is also possible for the adjuster to include a clamp having a U-shaped clamp member whose legs have outer threaded surfaces generated about a concentric axis in a spaced relationship to each other, with a bar clamp member that is received between the threaded legs to provide clamping action under the control of a single nut that is received by both threaded legs. Similarly, other constructions of the adjuster are possible.

At the opposite end of the draw force carrying member 72 from the adjuster 88, the device 20 includes the release mechanism 130.

As best illustrated in FIGS. 1 and 13, the release mechanism 130 has a forward end 131 at which the anchor point 54 is located, a rear end 133 connected to the draw force carrying member 72, and an intermediate portion 136 that supports the trigger 132. Thus, the release mechanism 130 provides a linkage between the anchor point and the string arm connector 70. The anchor point 54 permits the bow string 68 to be releasably engaged thereat, for uses previously described.

Each of the embodiments illustrated in FIGS. 2 and 3 includes some features of the construction of the shooting and training device 20 illustrated in FIG. 1, including the draw force carrying member 72. In FIG. 3, the draw force carrying member is provided with a front portion 110 extending forwardly from the anchor point 54 and has a strap 62, as opposed to an actual bow in the manner previously described. Thus, each of these embodiments 20 and **20*a* can be compactly stored and, in addition to being usable with an actual bow, the device 20** can be used to permit training without the bulk and inconvenience involved in transporting an actual bow.

Both of the embodiments 20 and **20*a* as respectively illustrated in FIGS. 2 and 3 train an archer to use the plane of release concept described previously by the use of isometrics, i.e. the muscles of the body working against each other in simulating the bow force. The embodiment 20a has the front portion 110 of the draw force carrying member provided with a cord-like construction having a rear end formed into a connection loop 112 that receives a ring 55, preferably made of metal, which is fixedly connected thereto and is detachably secured to the release mechanism 130 at the anchor point 54. The front portion 110 of the draw force carrying member 72 extends forwardly from the anchor point 54 and has an adjuster 114 that adjusts the length between the anchor point 54 and the bow handle or strap 62**.

Where the bow handle 62 comprises a strap, the strap itself may either be formed of an in-elastic, or elastic-like material, in which case the elastic-like material will extend under tension, and upon release, will return to its relaxed dimensions.

In the embodiment 28 depicted in FIG. 3, the shooting and training device 20 further comprises a tether 117 and a loop 119 which connects the front portion 110 of the draw force carrying member 72 to the bow arm so that when the release mechanism 130 is activated, the front portion 110 of the draw force carrying member 72 is retained by the bow arm, thus facilitating reassembly of the device 20 after release.

Figure 5:
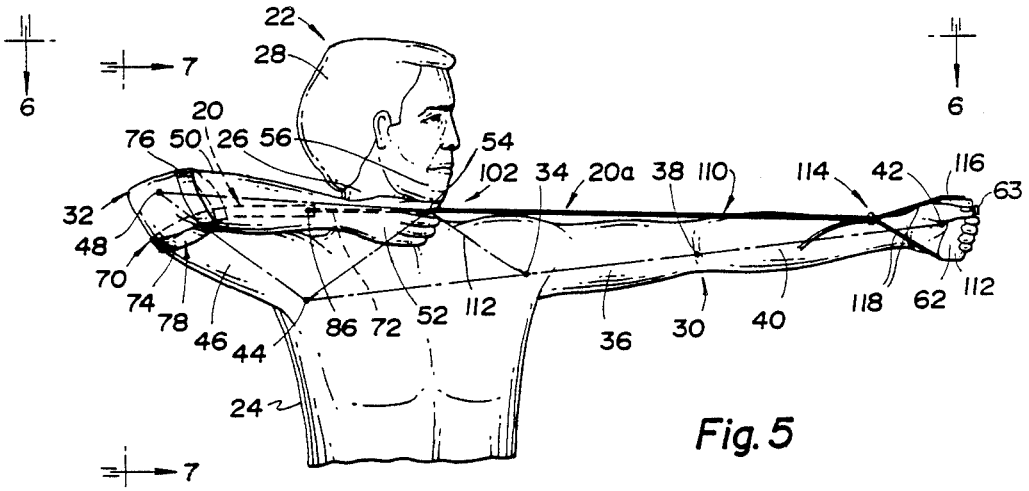
FIG. 5 is a side view of a right-hand archer utilizing the FIG. 3 embodiment of the shooting and training device having the bow handle, and is also illustrative of the way in which the embodiment of FIG. 3 is used.
Figure 6:
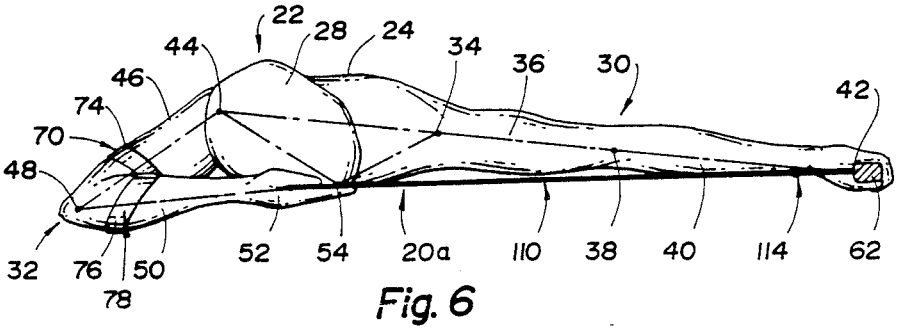
FIG. 6 is a top view taken along line 6—6 of FIG. 5 to further illustrate the manner in which the shooting and training device is used.

In the embodiment 20a of the shooting and training device illustrated in FIG. 5, the bow handle 62 includes a contoured handle surface 116 that is constructed like the handle of either a left-hand or right-hand bow handle. A vertical hole or passage 112 through the handle 62 of this embodiment receives a connection loop 118 at the forward end of the front portion 110 of the draw force carrying member 72. A suitable retainer clamp or threaded positioner 63 in the handle 62 can be used to lock the position of the connection loop 118, or the contoured bow handle 62 for correct bow hand pressure, after appropriate adjustment of the length of the cord-like front portion 110 between the anchor point 54 and the handle. Adjuster 114 that provides such length adjustment preferably has a U clamp construction like the adjuster 88 previously described, and thus includes a U-shaped clamp member, a bar clamp member, and a pair of nuts received by threaded legs of the U-shaped clamp member, such that the bar clamp member 98 clamps both strands of the connection loop 118.

As shown in FIG. 3, the embodiment 20a of the shooting and training device has the front portion 110 provided with a strap 120 whose ends 122 are folded back and a hole through which the connection loop 118 extends to permit adjustable securement by the adjuster 114. This strap embodiment of the bow handle 62 can thus be used by either left-hand or right-hand archers without the need for a different construction for each one.

The release mechanism 130 is further illustrated in FIG. 13, which shows use of the device as an archery aid by provision of the string release mechanism 130 of any conventional type which supports a pivotable trigger 132. The trigger 132 controls the release of the bow string 68 or ring 54 from the anchor point 54 by a pair of balls 134 that capture the spring 68 or ring 54 prior to release. As disclosed, the string release mechanism 130 can be oriented such that the trigger 132 extends horizontally from the intermediate portion 136, which position is used when the device 20 is used in combination with a bow string 68. When the device 20 is used in combination with the ring 54 connected to the front portion 110 and the strap or contoured bow handle 62, the release mechanism 130 can be oriented with trigger 132 extending horizontally, vertically, or at an intermediate position. The string release mechanism 130 is used with the embodiments 20 or 20a shown in FIGS. 1–6 and 13 to study the archer's body reaction movements upon release.

USE OF TRAINING DEVICE

Each embodiment is utilized as illustrated in FIGS. 4 through 8 as the archer holds an associated bow handle 62 with the bow hand 42 and with a string arm connector 70 secured to the string arm 32 as previously described in a manner that prevents shifting adjacent the elbow 48. The archer 22 extends the bow arm 30 so as to align the bow hand 42 with shoulders 34 and 44 and also bends the string arm 32 to the shooting position unit an anchor point 54 is located adjacent the archer's neck 26 and chin 56 as illustrated. In this position, the bow arm triangle A, body triangle B, and string arm triangle C illustrated in FIGS. 9 and 10 are all located along the plane of release D shown in FIGS. 11 and 12. The bow draw force is then transmitted along the force line F on the plane of release D. If a tensioned draw force carrying member 72 were then instantaneously cut, the archer's bow hand 42 would react by moving forwardly along the force line F on the plane of release D. At the same time, the string arm hand 52 would move rearwardly along the force line F on the plane of release D. Since no adverse resultant force or body rotation results, there is no movement from the plane of release in a manner that can adversely affect shooting.

It should be noted that the string arm 32 cannot move above or below the plane of release, as well as up or down if on the plane of release, when using a shooting and training device without movement of the anchor point 54, so as to give the archer an indication that he or she is using the wrong muscles. Also, movement of the anchor point away from the archer's neck shows the direction in which the resultant force will move the string hand and anchor point of bow string under actual shooting conditions. Specifically, if the string arm 32 is moved above the plane of release D, the string arm connector 70 tends to bend around the anchor point 54 and exert pressure on the neck 26 and/or chin 56. Similarly, if the string arm 32 drops below the plane of release D, the anchor point 54 tends to move away from the neck 26 and chin 56 which is also observable by the archer. The anchor point 54 also moves away from the neck and chin if the bow shoulder is located off the plane of release in a manner that produces body rotation upon shooting. Such movement of the anchor point when using the shooting and training device also teaches the archer to move the entire upper body when aiming for differing ranges of shooting requiring trajectories having varying angles of ascent. Thus, the archery shooting and training device teaches the archer proper muscular control and body positioning for accurate shooting in a manner that was not heretofore possible.

While the best modes for carrying out the invention have been described in detail, those familiar with the art to which this invention relates will recognize various alternative designs and embodiments for carrying out the invention as defined by the following claims.

What is claimed is:

1. An archery shooting and training device for assisting an archer, the device comprising: a string arm connector including a strap that defines a slip loop through which the strap passes to form a pair of loops which are attached to the string arm proximate the elbow thereof for positioning above and below the elbow, which upon tightening, cooperate together with said slip loop to secure the string arm connector to the string arm snugly without shifting under tension, distributing the tension of the string arm connector between the archer's upper arm and forearm proximate the elbow; a draw force carrying member having a cord-like construction extending forwardly from the string arm connector toward an anchor point; a release mechanism connected to the draw force carrying member adjacent the anchor point; and a mechanical adjuster for adjusting the length of the device between the elbow of the string arm and the anchor point to position the archer's bow hand, string arm, shoulders, and the anchor point along a plane of release where the muscles properly hold the bow force with positioning that maintains the bow hand and the anchor point against movement that would adversely affect accuracy upon string release during actual shooting.

2. An archery shooting and training device as in claim 1 wherein the pair of loops are formed by turning the strap back upon itself, the loops being respectively securable to the upper arm and forearm of the string arm adjacent the elbow.

3. An archery shooting and training device as in claim 2 wherein the adjuster is located between the string arm connector and the release mechanism and adjusts the distance between the anchor point and the string arm elbow.

4. An archery shooting and training device as in claim 3 wherein the adjuster connects the cord-like draw force carrying member to the strap that defines the pair of loops which are securable to the string arm.

5. An archery shooting and training device as in claim 3 or 4 wherein the adjuster comprises a U clamp.

6. An archery shooting and training device as in claim 1 or 4 wherein the release mechanism includes a trigger.

7. An archery shooting and training device as in claim 6 wherein the release mechanism has a forward end at which the anchor point is located, a rear end connected to the draw force carrying member, and an immediate portion that supports the trigger.

8. An archery shooting and training device as in claim 1, 2, 3, or 4, wherein the draw force carrying member has a front portion including a ring fixedly connected to the front portion, the ring being detachably secured to the release mechanism which, upon activation, releases the ring, the front portion extending forwardly from the release mechanism and the front portion having a bow handle held by the bow hand of the archer.

9. An archery shooting and training device as in claim 8, further comprising a tether which connects the front portion of the draw force carrying member to the bow arm so that when the release mechanism is activated, the front portion of the draw force carrying member is retained by the bow arm, thus facilitating reassembly of the device after release.

10. An archery shooting and training device as in claim 8 wherein the front portion of the draw force carrying member has a cord-like construction and includes an adjuster that adjusts the length of the cord between the release mechanism and the handle.

11. An archery shooting and training device as in claim 10 wherein the handle has a contoured construction, and wherein the adjuster of the front portion of the draw force carrying member provides connection thereof to the contoured handle.

12. An archery shooting and training device as in claim 10 wherein the handle includes a strap, and wherein the adjuster of the front portion of the draw force carrying member provides connection thereof to the strap of the handle.

13. An archery shooting and training device as in claim 12 wherein the strap comprises an elastic-like material which extends under tension, and upon release, returns to its relaxed dimensions.

14. An archery shooting and training device for providing an archer proper muscular control and upper body positioning, the shooting and training device comprising: a string arm connector including a strap that defines a slip loop through which the strap passes to form a pair of loops that are attached to the string arm proximate the elbow thereof for positioning above and below the elbow, which upon tightening, cooperate together with said slip loop to secure the string arm connector to the string arm snugly without shifting under tension, distributing the tension of the string arm connector between the archer's upper arm and forearm proximate the elbow; a draw force carrying member having a cord-like construction extending from the string arm connector; a bow handle connected to the draw force carrying member; a release mechanism including a trigger, connected to the draw force carrying member; and a mechanical adjuster for adjusting the length of the draw force carrying member between the string arm connector and the bow handle to position the archer's bow hand, string arm, shoulders, and the release mechanism along a plane of release where the muscles properly hold the bow force with positioning that maintains the bow hand and the anchor point against movement that would adversely affect accuracy upon string release during actual shooting.

15. An archery shooting and training device for teaching an archer having shoulders, muscles, a bow hand and a string arm proper muscular control and upper body positioning, the shooting and training device comprising: a string arm connector including a strap that defines a slip loop through which the strap passes to form a pair of loops that are attached to the string arm proximate the elbow thereof, which upon tightening, secure the string arm connector to the string arm snugly, distributing the tension of the string arm connector between the archer's upper arm and forearm proximate the elbow, and which are respectively securable to the upper arm and forearm of the archer's string arm; a draw force carrying member having a single cord-like construction that extends forwardly from the string arm connector toward an anchor point; a release mechanism connected to the draw force carrying member adjacent the anchor point; an adjuster that secures the draw force carrying member to the string arm connector and adjusts the length of the draw force carrying member between the release mechanism and the string arm connector; a trigger mounted upon the release mechanism which is secured to the draw force carrying member, the draw force carrying member having a front portion that extends forwardly from the release mechanism; a bow handle to which the front portion of the draw force carrying member extends; and a mechanical adjuster that adjustably secures the bow handle to the front portion of the draw force carrying member to adjust the length thereof between the release mechanism and the bow handle such that the shooting and training device positions the archer's bow hand, string arm, shoulders, and the release mechanism along a plane of release where the muscles properly hold the bow force with positioning that maintains the bow hand and the release mechanism against movement that would adversely affect accuracy upon string release during actual shooting.

16. An archery shooting and training device as in claim 15 wherein the bow handle has a contoured construction.

17. An archery shooting and training device as in claim 15 wherein the bow handle includes a passage through which the front portion extends; and a retainer clamp which secures the front portion within the passage.

18. An archery shooting and training device as in claim 15 wherein the bow handle comprises a strap.

19. An archery shooting and training device as in claim 15 wherein the strap comprises an elastic-like material which extends under tension and upon release returns to its relaxed dimensions.

20. An archery shooting and training device for teaching an archer having a bow arm, a bow hand and a string arm, proper muscular control and upper body positioning, the shooting and training device comprising: a string arm connector including a strap that defines a slip loop through which the strap passes to form a pair of loops that are attached to the string arm proximate the elbow thereof, which upon tightening, secure the string arm connector to the string arm snugly, distributing the tension of the string arm connector between the archer's upper arm and forearm proximate the elbow, and which are respectively securable to the upper arm and forearm of the archer's string arm adjacent the elbow thereof; a draw force carrying member having a single cord-like construction that extends forwardly from the string arm connector toward an anchor point; an adjuster attached to the string arm connector for adjusting the length of the draw force carrying member; a release mechanism having a trigger, the release mechanism being connected to the draw force carrying member; a front portion including a bow handle held by the bow hand of the archer, the front portion being detachably secured to the draw force carrying member by the release mechanism, the front portion extending forwardly from the release mechanism; and a mechanical adjuster connected to the front portion for adjusting the distance between the release mechanism and the bow handle.

21. An archery shooting and training device as in claim 20 wherein the handle comprises a strap, and wherein the adjuster of the front portion of the draw force carrying member provides connection thereof to the strap of the handle.

22. An archery shooting and training device as in claim 20 or 21 further comprising a tether and a loop which connects the front portion of the draw force carrying member to the bow arm so that upon activation of the release mechanism, the front portion is retained by the bow arm, thus facilitating reassembly of the device after release.

23. An archery shooting and training device as in claim 22 wherein the front portion of the draw force carrying member comprises a ring connected to the front portion, the ring being detachably secured to the release mechanism.

24. An archery shooting and training device for providing an archer proper muscular control and upper body positioning, the archery device comprising: a string arm connector including a strap that defines a slip loop through which the strap passes to form a pair of loops that are attached to the string arm proximate the elbow thereof for positioning above and below the elbow, which upon tightening, cooperate together with said slip loop to secure the string arm connector to the string arm snugly without shifting under tension, distributing the tension of the string arm connector between the archer's upper arm and forearm proximate the elbow; a mechanical adjuster connected to the string arm connector for adjusting the length of the string arm connector; and a release mechanism to secure and release the bow string, connected to the string arm connector proximate the adjuster to position the archer's bow hand, string arm, and shoulders and the release mechanism along a plane of release where the muscles properly hold the bow force with positioning that maintains the bow hand and the release mechanism against movement that would adversely affect accuracy upon string release during actual shooting.

25. An archery shooting and training device for providing an archer proper muscular control and body positioning, the archery device comprising: a string arm connector, including a strap that defines a slip loop through which the strap passes to form a pair of loops that are attached to the string arm proximate the elbow thereof for positioning above and below the elbow, which upon tightening, cooperate together with said slip loop to secure the string arm connector to the string arm snugly without shifting under tension, distributing the tension of the string arm connector between the archer's upper arm and forearm proximate the elbow; a draw force carrying member having a cord-like construction extending forwardly from the string arm connector toward an anchor point; a mechanical adjuster for adjusting the length of the draw force carrying member, attached to the draw force carrying member; and a release mechanism having a trigger, the release mechanism being connected to the draw force carrying member.

* * * * *